US005181586A

United States Patent [19]

Yoo et al.

[11] Patent Number: 5,181,586

[45] Date of Patent: Jan. 26, 1993

[54] NOISE AND VIBRATION REDUCTION AT ELEVATOR CAB HITCH

[75] Inventors: Young S. Yoo, Avon; John K. Salmon, South Windsor, both of Conn.

[73] Assignee: Otis Elevator Company, Farmington, Conn.

[21] Appl. No.: 759,287

[22] Filed: Sep. 13, 1991

[51] Int. Cl.[5] ..... B66B 9/00

[52] U.S. Cl. ..... 187/1 A; 187/20

[58] Field of Search ..... 187/20, 1 R, 1 A; 254/266, 389

[56] References Cited

U.S. PATENT DOCUMENTS

| | | | |
|---|---|---|---|
| 1,721,603 | 7/1929 | Neenan | 187/20 |
| 2,308,211 | 1/1943 | Sanford | 187/29 |
| 5,009,288 | 4/1991 | Nakai et al. | 187/20 |

*Primary Examiner*—D. Glenn Dayoan
*Assistant Examiner*—Kenneth Noland
*Attorney, Agent, or Firm*—William W. Jones

[57] ABSTRACT

An elevator cable hitch plate is isolated for the cab frame crosshead by an elastomeric pad and a mounting plate bolted to the crosshead is disposed between the pad and the crosshead. A stabilizer bracket is fixed to the mounting plate and to the hitch plate. The bracket allows limited vertical movement of the mounting plate and hitch plate relative to each other, but prevents lateral sliding movement therebetween. The bracket thus prevents the hoist cable thimble rods from contacting the edges of the holes in the plates through which the thimble rods pass. Minimal cable-induced vibration and noise is thus produced during operation of the elevator.

4 Claims, 2 Drawing Sheets

NOISE AND VIBRATION REDUCTION AT ELEVATOR CAB HITCH

DESCRIPTION

Technical Field

This invention relates to the reduction of vibration and noise caused by contact between elevator cables and the hitch plate or cross-head in an elevator cab assembly.

Background Art

An elevator cab assembly is suspended in the elevator hoistway on cables which are snubbed to a hitch plate by means of thimble rods. Coil springs are typically mounted on the thimble rods and engage the hitch plate to provide some degree of vertical elasticity to the cab assembly mount. Efforts have been made to further damp the connection between the cables and the cab assembly to limit the creation of vibration and noise at the connection, and to prevent transmittal of such vibration and noise to the cab and its occupants.

U.S. Pat. No. 2,308,211 granted Jan. 12, 1943 to S.B. Sanford discloses an elevator hitch assembly which includes the aforesaid cables, thimble rods, and coil springs, and which also includes a mounting plate bolted to the cab frame crosshead, and a rubber isolation pad interposed between the mounting plate and the hitch plate. The thimble rods pass through the hitch plate, the rubber pad, and the mounting plate. The rubber pad is held in place between the hitch and mounting plates by bolt heads which are nested in recesses in the rubber pad. The rubber pad thus serves to add vertical elasticity to the mount assembly and also serves to retard horizontal shifting of the hitch and mounting plates relative to each other and to the thimble rods. The objective of the rubber pad is thus, in part, to prevent contact between the thimble rods and the holes in the two plates through which the thimble rods pass. The problem with using the rubber pad in such a manner is that in order to retard horizontal shifting of the two plates, the rubber must have a relatively high hardness which will inherently lessen its ability to isolate the two plates from each other to prevent transmission of vibrations from one plate to the other. The rubber pad thus cannot inherently provide maximum goal realization.

DISCLOSURE OF THE INVENTION

This invention relates to an improved elevator hitch assembly wherein rope induced noise and vibration are reduced. The mount assembly includes a plurality of plates which are isolated from each other by elastomeric pads. The thimble rods pass through enlarged openings in the plates and pads, and carry coil springs which engage the lowermost of the plates. A bracket is connected to each of the plates in each pair thereof. The bracket bridges the edge of the isolation pad and does not touch the latter. The bracket is formed from thin steel sheet strip and provides a vertically resilient connection between the plates, while at the same time supplying considerable horizontal rigidity between the plates. Thus the plates cannot slide laterally over the pad with respect to each other, and the initial positioning of the thimble rods with respect to the plates will be maintained. Contact between the thimble rods and plates is thus prevented.

It is therefore an object of this invention to provide an improved elevator cable hitch assembly for an elevator cab.

It is a further object of this invention to provide an elevator cable hitch assembly of the character described which ensures a low vibration quiet connection between the elevator cab assembly and the elevator cables.

These and other advantages of the invention will become more readily apparent from the following detailed description of a preferred embodiment thereof, when taken in conjunction with the accompanying drawings, in which:

BEST MODE FOR CARRYING OUT THE INVENTION

Figure 1:
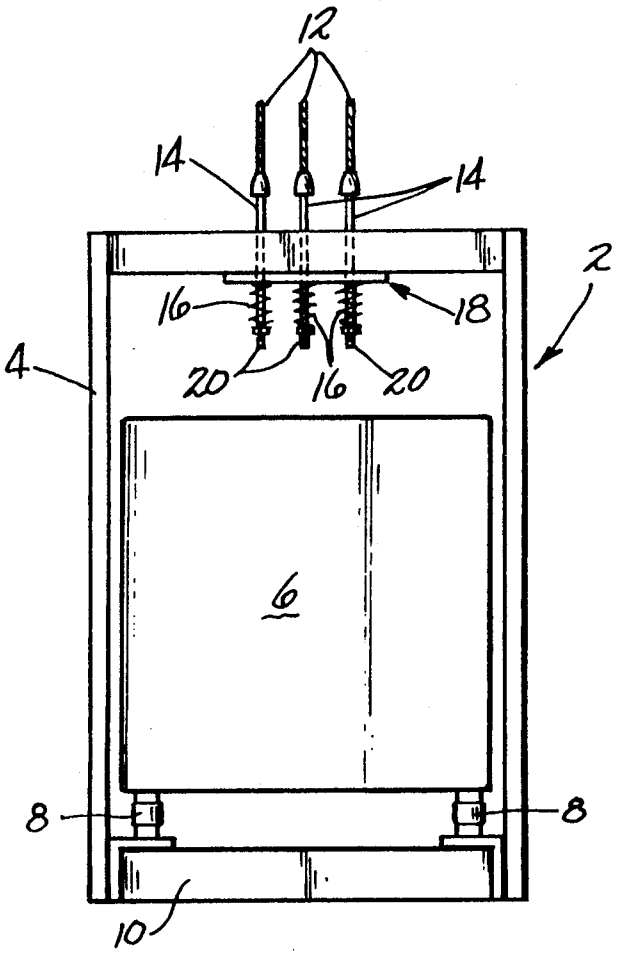
FIG. 1 is a schematic elevational view of an elevator cab assembly which is provided with a preferred embodiment of the cable hitch assembly of this invention.

Referring to the drawings, FIG. 1 shows a typical elevator cab assembly, denoted generally by the numeral 2, which includes a frame 4 that carries the passenger cab 6. The cab 6 is mounted on shock-absorbing pads 8 on the lower cross piece 10 of the frame 4. Cables 12 suspend the cab assembly 2 in an elevator hoistway. The cables 12 are secured to thimble rods 14 in a conventional manner, and the thimble rods 14 carry coil springs 16 which bear against the hitch plate assembly 18 of this invention. The springs 16 are retained on the thimble rods 14 by nut and washer combinations 20 threaded onto the bottom end of each thimble rod 14.

Figure 2:
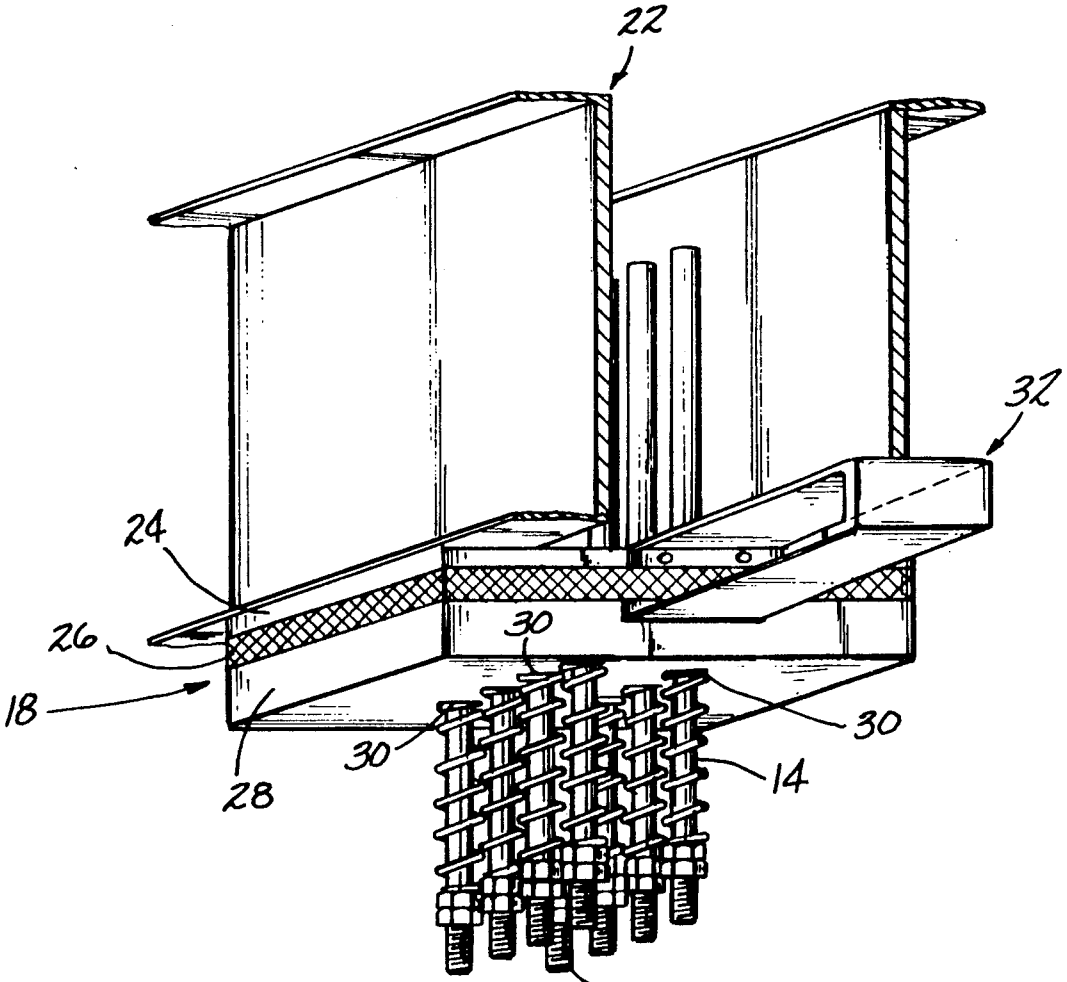
FIG. 2 is a fragmented perspective view of the hitch plate assembly of FIG. 1.

FIG. 2 shows details of the hitch plate assembly 18. The hitch plate assembly 18 includes a mounting plate 24 connected to the cab assembly frame crosshead 22. An elastomeric isolation pad 26 is sandwiched between the mounting plate 24 and the hitch plate 28. The pad 26 can be made from ISO-PAD which features a patented, cross-ribbed construction that is designed to provide effective isolation. It is molded of durable, resilient duPont Neoprene. The pad can also be made out of natural rubber, silicone elastomer, or Butyl. The thimble rods 14 pass through oversized openings 30 in the plates 24,28 and in the pad 26. The rods 14 are relatively centered in the openings 30 so that no contact between the plates 24,28 or pad 26 and the rods 14 will occur. This ensures that cable-induced vibrations and movement will not be converted into cab vibration and noise by the rods 14. A stabilizer bracket 32 interconnects the plates 24 and 28 and bridges the pad 26. The bracket 32 is bolted to side surfaces of the plates 24 and 28.

Figure 3:
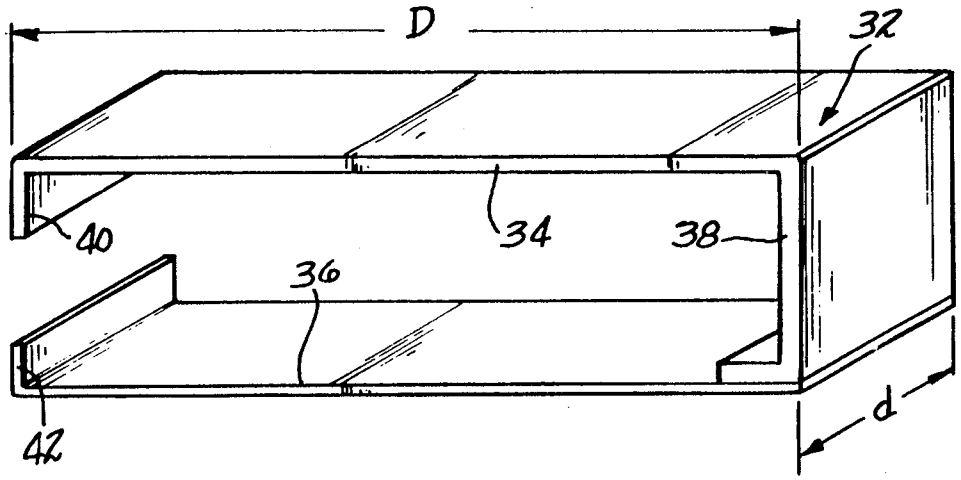
FIG. 3 is a perspective view of the stabilizer bracket part of the hitch plate assembly.

FIG. 3 shows details of the bracket 32. The bracket 32 is generally U-shaped and has two parallel spaced-apart legs 34 and 36 connected by a bridge 38. Bent flanges 40 and 42 on the legs 34 and 36 provide means for fastening the bracket 32 to the plates 24 and 28. It will be noted that the leg 34 is somewhat thicker than the leg 36. The different thicknesses provide a combination of good vertical springiness along with appropriate torsional stiffness. For example, the leg 34 can have a thickness of about 0.250 inches (6 mm); and the leg 36 can have a thickness of about 0.060 inches (2 mm). The length D of the bracket 32 is preferably about 12 inches (30 cm); and the width d of the bracket 32 is preferably about 5 inches (13 cm). These dimensions can of course be varied but these specific values will result in a hitch assembly with a desirable degree of vertical flexibility so as not to null out the pad 26. At the same time, the bracket 32 will supply sufficient torsional stiffness to prevent the plates 24 and 28 from shifting laterally with respect to each other and the pad 26. The position of the thimble rods 14 in the openings 30 is thus maintained during operation of the elevator whereby an extended vibration and noise-free environment is provided in the cab. While a generally rectangular shape for the bracket 32 is depicted in the drawings, it will be understood that brackets having curvilinear legs, and which are fastened to the plates 24 and 28 through the plane of the plates could also be used. Since the bracket 32 acts as a spring in the vertical plane, a springy metal which resists fatigue is preferred for forming the bracket 32.

The hitch plate is restrained in the lateral movement but allowed to move in the vertical direction, thus accommodating the vertical motion of the hitch plate due to deflections of the hitch springs and the elastomeric pad as the loads of the car vary due to static and dynamic load variations during the elevator operations. This is accomplished by a simple positioning device using the characteristics of a thin plate which is very stiff in the in plane motion, while at the same time being very flexible in bending.

Since many changes and variations of the disclosed embodiment of the invention may be made without departing from the inventive concept, it is not intended to limit the invention otherwise than as required by the appended claims.

What is claimed is:

1. A hitch plate assembly for an elevator, said assembly comprising:

a) first and second horizontal metal plates having a plurality of aligned openings;

b) an elastomeric pad interposed between said metal plates and operable to vibrationally isolate said plates from each other, said pad having a plurality of openings therein corresponding to the aligned openings in said plates;

c) elevator suspension means extending through said plate and pad openings, said suspension means being sized so as to be free of contact with said plates and pad in said openings; and d) spring means interconnecting said plates, said spring means providing a connection having vertical flexibility between said plates and concurrent horizontal rigidity sufficient to prevent lateral shifting of said plates relative to each other whereby said suspension means are maintained free of said contact with said plates during operation of the elevator.

2. The hitch plate assembly of claim 1 wherein said suspension means comprises a plurality of thimble rods extending through said plate and pad openings, each of said thimble rods being connected to a respective coil spring which bears against an undersurface of the lowermost of said plates.

3. The hitch plate assembly of claim 1 wherein said spring means is a metal bracket fastened to each of said plates and extending around a side surface of said pad to interconnect said plates.

4. The hitch plate assembly of claim 3 wherein said bracket comprises a relatively thick arm connected to the uppermost of said plates, and a relatively thin arm interconnecting said thick arm and the lowermost of said plates.

* * * * *

UNITED STATES PATENT AND TRADEMARK OFFICE

CERTIFICATE OF CORRECTION

PATENT NO. : 5,181,586

DATED : January 26, 1993

INVENTOR(S) : Donald E. Weder

It is certified that error appears in the above-indentified patent and that said Letters Patent is hereby corrected as shown below:

Column 1, Line 61, after grouping, please delete ",".

Column 2, Line 45, after material, please add --28--.

Column 3, Line 20; after material, please add --28--.

Column 3, Line 24; after and 14, please delete "size" and substitute therefore --sized--.

Column 1, Line 48; after being, please delete "connected" and replace with --disconnected--.

Column 3, Line 51, after item, please delete ". Therein" and substitute therefore --therein--.

Column 3, Line 57, please delete "ABw" and substitute therefore --ABW--.

Column 4, Line 59; after the, please delete "strips" and substitute therefore --sheets--.

Column 5, Line 24; after direction, please delete "32" and substitute therefore --32a--".

UNITED STATES PATENT AND TRADEMARK OFFICE

CERTIFICATE OF CORRECTION

PATENT NO. : 5,181,586

DATED : January 26, 1993

INVENTOR(S) : Donald E. Weder

It is certified that error appears in the above-indentified patent and that said Letters Patent is hereby corrected as shown below:

Column 5, Line 40, after could be, please delete "selective" and substitute therefore --selectively--.

Column 5, Line 42, please delete "10a" and substitute therefore --10--.

Column 7, Line 61; after no, please delete "lose" and substitute therefore --loose--.

Column 10, Line 5; after no, please delete "lose" and substitute therefore --loose--".

Signed and Sealed this

Twenty-fifth Day of January, 1994

*Attest:*

*Attesting Officer*

Bruce Lehman

BRUCE LEHMAN

*Commissioner of Patents and Trademarks*